US012698780B2

(12) United States Patent
Ochitani et al.

(10) Patent No.: US 12,698,780 B2
(45) Date of Patent: Aug. 4, 2026

(54) MOTOR AND FAN MOTOR

(71) Applicant: NIDEC CORPORATION, Kyoto (JP)

(72) Inventors: Shunichi Ochitani, Kyoto (JP); Masahiro Otani, Kyoto (JP); Takuro Kawano, Kyoto (JP); Rei Sakai, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 18/894,377

(22) Filed: Sep. 24, 2024

(65) Prior Publication Data

US 2025/0109750 A1 Apr. 3, 2025

(30) Foreign Application Priority Data

Sep. 28, 2023 (JP) ..... 2023-166850

(51) Int. Cl.
*F04D 25/08* (2006.01)
*F04D 29/056* (2006.01)

(52) U.S. Cl.
CPC ..... *F04D 25/08* (2013.01); *F04D 29/0563* (2013.01)

(58) Field of Classification Search
CPC .... F04D 25/08; F04D 29/0563; F04D 25/062; F04D 29/056; F04D 29/057
See application file for complete search history.

(56) References Cited

U.S. PATENT DOCUMENTS

2007/0222314 A1* 9/2007 Drautz ..... F16C 17/102 310/90
2009/0022438 A1* 1/2009 Tamaoka ..... G11B 19/2036 310/90
2009/0232430 A1* 9/2009 Ito ..... F16C 17/107 384/114
2010/0226601 A1* 9/2010 Inazuka ..... H02K 5/1675 384/107
2010/0232733 A1* 9/2010 Ito ..... F16C 17/107 384/107
2014/0072423 A1* 3/2014 Yoo ..... F04D 17/16 415/203
2015/0023814 A1* 1/2015 Tamaoka ..... F04D 19/002 417/354
2016/0230769 A1 8/2016 Komatsubara
2022/0127455 A1* 4/2022 Okuzawa ..... C08K 7/14

* cited by examiner

*Primary Examiner* — Matthew T Largi
(74) *Attorney, Agent, or Firm* — Keating & Bennett, LLP

(57) ABSTRACT

In a motor, a rotor is supported by a bearing to be rotatable about a central axis extending in an axial direction. The rotor includes a rotor lid portion and a first protruding portion. The rotor lid portion extends in a radial direction. The first protruding portion protrudes in one axial direction from the rotor lid portion, extends along the central axis, and is rotatably supported by a bearing. The bearing has a cylindrical shape extending in the axial direction and surrounds the first protruding portion. A hole extending in another axial direction is located in an end portion in the one axial direction of the first protruding portion. An axial length of the hole is less than about half of an axial length of the first protruding portion.

9 Claims, 1 Drawing Sheet

MOTOR AND FAN MOTOR

CROSS-REFERENCE TO RELATED APPLICATIONS

The present application claims priority under 35 U.S.C. § 119 to Japanese Patent Application No. 2023-166850, filed on Sep. 28, 2023, the entire contents of which are hereby incorporated herein by reference.

1. FIELD OF THE INVENTION

The present disclosure relates to motors and fan motors.

2. BACKGROUND

Conventionally, a fan motor in which a rotor blade is rotatable in a circumferential direction together with a rotor is known. For example, the fan motor includes a bearing device, a plurality of fans such as a rotor blade, and a drive unit for rotating the fan together with a rotating member. The bearing device includes a rotating member such as a rotor and a bearing. A plurality of fans are provided in the rotating member. The rotating member includes a hub portion and a shaft portion. The shaft portion is formed integrally with the hub portion and is inserted into an inner periphery of a bearing. The drive unit includes a coil on the fixed side and a magnet fixed to the hub portion on the rotation side. The rotating member rotates relative to the bearing when the magnet rotates by excitation force between the rotating member and the coil.

However, conventionally, the shaft portion of the rotating member has a cylindrical shape extending in an axial direction. For this reason, for example, when an attempt is made to adjust a posture of the rotating member by applying external force in order to adjust rotation balance and the like after assembling the fan motor, there is a possibility that the shaft portion is deformed due to insufficient strength and rigidity of the shaft portion. That is, there is a case where it is difficult to adjust a posture of the rotating member after assembly.

SUMMARY

In an example embodiment of a motor of the present disclosure, a rotor is supported by a bearing to be rotatable about a central axis extending in an axial direction. The rotor includes a rotor lid portion and a first protruding portion. The rotor lid portion extends in a radial direction. The first protruding portion protrudes in one axial direction from the rotor lid portion, extends along the central axis, and is rotatably supported by the bearing. The bearing has a cylindrical shape extending in the axial direction and surrounds the first protruding portion. A hole extending in another axial direction is located in an end portion in the one axial direction of the first protruding portion. An axial length of the hole is less than about half of an axial length of the first protruding portion.

An example embodiment of a fan motor of the present disclosure includes the motor according to the example embodiment of the present invention described above.

The above and other elements, features, steps, characteristics and advantages of the present disclosure will become more apparent from the following detailed description of the example embodiments with reference to the attached drawings.

DETAILED DESCRIPTION

Example embodiments will be described with reference to the drawings hereinafter.

Note that, in the present description, in a fan motor 100 and a motor 101, a direction parallel to a central axis CA is referred to as "axial direction". Of the axial directions, a direction from a base portion 33 to a rotor lid portion 11 described later is referred to as "one axial direction Da", and a direction from the rotor lid portion 11 to the base portion 33 is referred to as "another axial direction Db". Further, a direction orthogonal to the central axis CA is referred as "radial direction". Of the radial directions, a direction approaching the central axis CA is referred to as "radially inward", and a direction away from the central axis CA is referred to as "radially outward". Further, a rotation direction about the central axis CA is referred to as "circumferential direction".

Further, in the present description, an "annular shape" includes not only a shape continuously connected without any cut along the entire circumference in the circumferential direction around the central axis CA, but also a shape having one or more cuts in a part of the entire circumference around the central axis CA. Further, the "annular shape" also includes a shape having a closed curve on a curved surface that intersects with the central axis CA around the central axis CA.

Further, in a positional relationship between any one of an azimuth, a line, and a plane and another, "parallel" includes not only a state in which both of them do not intersect at all no matter how long they extend, but also a state in which they are substantially parallel. Further, "perpendicular" and "orthogonal" include not only a state in which both of them intersect each other at 90 degrees, but also a state in which they are substantially perpendicular and a state in which they are substantially orthogonal. That is, each of "parallel", "perpendicular", and "orthogonal" includes a state in which a positional relationship between the two of them permits an angular deviation to a degree not departing from the spirit of the present disclosure.

Note that these are names used merely for description, and are not intended to limit actual positional relationships, directions, names, and the like.

Figure 1:
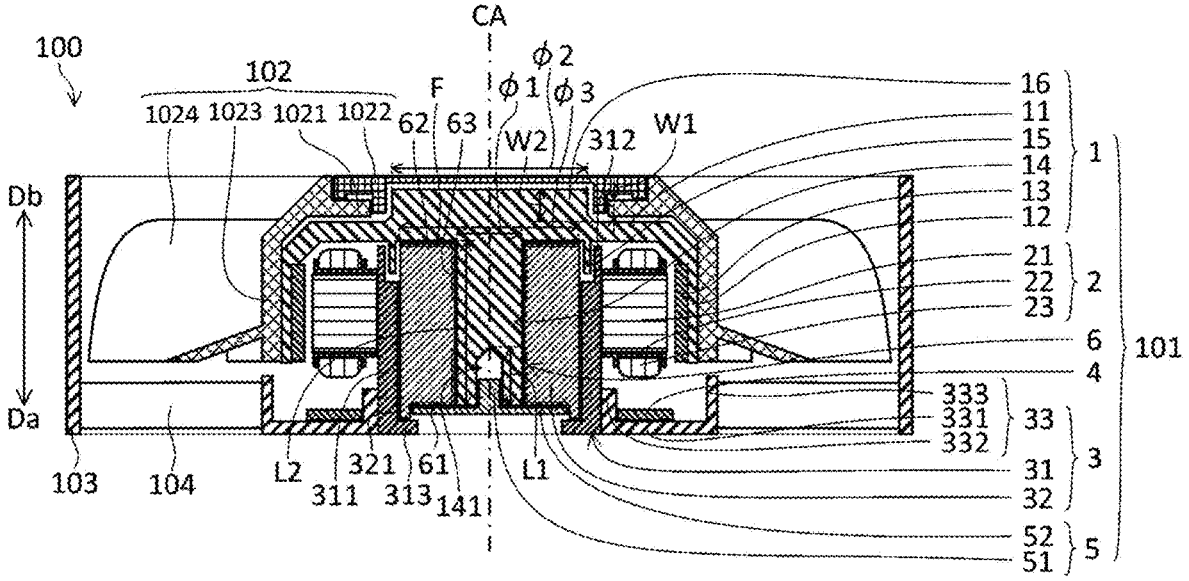
FIG. 1 is a cross-sectional view illustrating a configuration example of a fan motor according to an example embodiment of the present disclosure.
Figure 2:
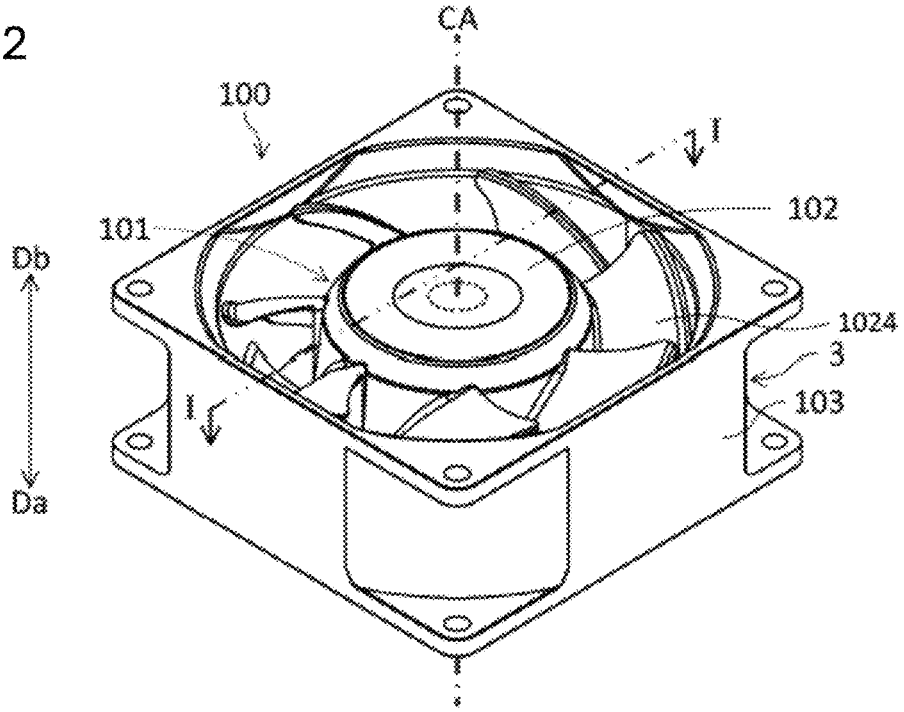
FIG. 2 is a perspective view illustrating an appearance of the fan motor.

FIG. 1 is a cross-sectional view illustrating a configuration example of the fan motor 100. FIG. 2 is a perspective view illustrating an appearance of the fan motor 100. FIG. 1 illustrates a cross-sectional structure in a case where the fan motor 100 is virtually cut along a plane including a two-dot chain line I-I and the central axis CA in FIG. 2.

The fan motor 100 of the present example embodiment is an axial fan that sends out air flow in the axial direction. However, this exemplification does not exclude a configuration in which the fan motor 100 is other than an axial fan. For example, the fan motor 100 may be a blower fan or a centrifugal fan.

As illustrated in FIGS. 1 and 2, the fan motor 100 includes a motor 101 and an impeller 102. The impeller 102 is rotatable about the central axis CA together with a rotor 1 of the motor 101 to be described later, and is fixed to at least the rotor lid portion 11 of the rotor 1. The motor 101 rotationally drives the impeller 102. In the fan motor 100 of the present example embodiment, as will be described later, a posture of the rotor 1 (and the impeller 102) can be safely adjusted even after assembly.

The impeller 102 includes an impeller lid portion 1021, an impeller cap 1022, an impeller cylindrical portion 1023, and a plurality of rotor blades 1024. The impeller lid portion 1021 has an annular shape surrounding a second protruding portion 16 described later of the rotor 1, and is arranged on an end surface in another axial direction of the rotor lid portion 11. As described above, the impeller 102 includes the impeller lid portion 1021. The impeller cap 1022 is arranged in an inner end portion in the radial direction of the impeller lid portion 1021 and covers an opening (reference numeral is omitted) of the impeller lid portion 1021 and an end portion in one axial direction of the second protruding portion 16 of the rotor 1. Note that the opening is arranged radially inward of an inner end portion in the radial direction of the impeller lid portion 1021. Further, the impeller cap 1022 can be omitted. The impeller cylindrical portion 1023 has a cylindrical shape and extends in the one axial direction Da from an outer end portion in the radial direction of the impeller lid portion 1021. Note that the impeller lid portion 1021 and the impeller cylindrical portion 1023 extend in the axial direction to constitute an impeller base (reference numeral is omitted) having a capped cylindrical shape attached to the rotor 1. A plurality of the rotor blades 1024 are arranged on an outer surface in the radial direction of the impeller cylindrical portion 1023 and arranged in the circumferential direction. When the motor 101 rotates the impeller 102, the rotor blade 1024 rotates in the circumferential direction. By the above, airflow flows in the axial direction.

Preferably, a material of the impeller 102 is polycarbonate resin. Polycarbonate resin is a material having high toughness and mechanical strength. Therefore, rigidity of the impeller 102 can be improved by employing polycarbonate resin. However, this exemplification does not exclude a configuration in which a material of the impeller 102 is not polycarbonate resin. For example, a material of the impeller 102 may be a resin material other than polycarbonate resin, or may be a metal material such as Al or an Al alloy.

Note that the present disclosure is not limited to the above example, and the rotor blade 1024 may be integrated with the rotor 1, or a plurality of the rotor blades 1024 may be arranged side by side on an outer surface in the radial direction of the rotor 1. In this case, the impeller lid portion 1021, the impeller cap 1022, and the impeller cylindrical portion 1023 are omitted.

Further, the fan motor 100 further includes a cylindrical casing 103 and a rib 104. The cylindrical casing 103 extends in the axial direction and surrounds the motor 101 and the impeller 102. The cylindrical casing 103 faces the motor 101 and the impeller in the radial direction with a gap between them, and forms a wind tunnel (reference numeral is omitted) through which air flow flows in a space between them. A plurality of the ribs 104 extend at least in the radial direction and are arranged side by side in the circumferential direction on the one axial direction Da side of the wind tunnel. The rib 104 functions as a stator blade that smooths airflow flowing in the wind tunnel. Further, the rib 104 connects the base portion 33 of the motor 101 and an end portion in one axial direction of the cylindrical casing 103. That is, an inner end portion in the radial direction of the rib 104 is connected to the base portion 33. An outer end portion in the radial direction of the rib 104 is connected to an inner surface in the radial direction of the cylindrical casing 103.

Next, a configuration example of the motor 101 will be described with reference to FIGS. 1 and 2. The motor 101 includes the rotor 1, a stator 2, a housing 3, a circuit board 4, a stop portion 5, a first dynamic pressure groove 61, a second dynamic pressure groove 62, and a third dynamic pressure groove 63. Note that, hereinafter, the first dynamic pressure groove 61, the second dynamic pressure groove 62, and the third dynamic pressure groove 63 may be collectively referred to as the "dynamic pressure groove 6".

In the motor 101 of the present example embodiment, the rotor 1 is supported by a bearing 32 so as to be rotatable about the central axis CA extending in the axial direction. In the present example embodiment, the rotor 1 is made from metal such as stainless steel, Al, or an Al alloy.

The rotor 1 includes the rotor lid portion 11, a rotor cylindrical portion 12, a magnet 13, a first protruding portion 14, a wall portion 15, and a second protruding portion 16.

The rotor lid portion 11 expands in the radial direction. As described above, the rotor 1 includes the rotor lid portion 11. The rotor lid portion 11 is arranged further in the another axial direction Db than the stator 2.

Further, the rotor cylindrical portion 12 extends in the one axial direction Da from an outer end portion in the radial direction of the rotor lid portion 11. As described above, the rotor 1 includes the rotor cylindrical portion 12. The rotor cylindrical portion 12 has a cylindrical shape surrounding the stator 2.

The impeller 102 (specifically, an impeller base) is fixed to the rotor lid portion 11 and the rotor cylindrical portion 12. In this way, the impeller 102 can be retrofitted to the rotor 1. Therefore, it is easy to perform correction such as shake correction after fixing. Furthermore, if the correction is performed or external force acts on the impeller 102, a support structure of the rotor 1 is hardly affected. Therefore, it is possible to reduce or prevent the bearing 32 supporting the rotor 1 from being damaged. Therefore, also after the fan motor 100 is assembled, a posture of the impeller 102 can be safely adjusted.

In the present example embodiment, the rotor cylindrical portion 12 is press-fitted into the impeller cylindrical portion 1023, so as to be fixed to an inner peripheral surface (inner surface in the radial direction) of the impeller cylindrical portion 1023. At the time of press-fitting, the rotor lid portion 11 is prevented from abutting against the impeller 102 in the axial direction. That is, in the axial direction, an upper surface of the rotor lid portion 11 faces the impeller 102 (for example, a lower surface of the impeller lid portion 1021) with an annular gap surrounding the central axis CA. In other words, an upper surface of the rotor lid portion 11 and a lower surface of the impeller lid portion 1021 do not contact each other in the axial direction over the entire circumference in the circumferential direction.

In this manner, when the impeller 102 is attached to the rotor 1 by press-fitting, for example, a press-fitting jig having high parallelism accuracy is used, so that it is possible to prevent fluctuation of the impeller 102 during rotation. Specifically, when the rotor cylindrical portion 12 is press-fitted to an inner peripheral surface of the impeller cylindrical portion 1023, a press-fitting jig with high parallelism accuracy is arranged between an upper surface of the rotor lid portion 11 and a lower surface of the impeller lid portion 1021 in the axial direction. By the above, a gap can be formed between the rotor lid portion 11 and the impeller lid portion 1021 in a state where the rotor lid portion 11 and the impeller lid portion 1021 are accurately parallel to each other, and abutment between the rotor lid portion 11 and the impeller lid portion 1021 can be prevented at the time of press-fitting. In other words, it is possible to prevent the rotor lid portion 11 from abutting on the impeller lid portion 1021 in the axial direction. For this reason, if one of an upper surface of the rotor lid portion 11 and a lower surface of the impeller lid portion 1021 is inclined from a plane perpendicular to a rotation axis (the central axis CA) of the rotor 1, the other can be prevented from being inclined from the plane due to abutment. That is, if the rotor cylindrical portion 12 does not abut on the impeller cylindrical portion 1023, the rotor cylindrical portion 12 and the impeller cylindrical portion 1023 can be accurately made parallel to each other because the rotor cylindrical portion 12 is press-fitted to an inner peripheral surface of the impeller cylindrical portion 1023 in conformity with a press-fitting jig. Therefore, it is possible to prevent a central axis of the impeller 102 from deviating from a rotation axis (that is, the central axis CA) of the rotor 1 due to abutment between the rotor lid portion 11 and the impeller lid portion 1021. Further, if rotation fluctuation of the impeller 102 occurs after attachment, a gap is arranged between an upper surface of the rotor lid portion 11 and a lower surface of the impeller lid portion 1021, so that a position of a portion where the fluctuation of the impeller 102 is large can be adjusted by pressurizing the portion in one axial direction (that is, to the rotor 1 side). That is, also after attachment, a relative positional relationship of a central axis of the impeller 102 with respect to a rotation axis (that is, the central axis CA) of the rotor 1 can be easily adjusted, and fluctuation of the impeller 102 can be effectively prevented.

The magnet 13 is arranged on an inner surface in the radial direction of the rotor cylindrical portion 12, and faces the stator 2 (in particular, a stator core 21 to be described later) in the radial direction. For example, the magnet 13 is arranged radially outward of the stator 2 (particularly the stator core 21) and surrounds the stator 2 (particularly the stator core 21). On an inner surface in the radial direction of the magnet 13, a plurality of different magnetic poles (S pole, N pole) are alternately arranged in the circumferential direction. Note that the magnet 13 may be directly arranged on an inner surface in the radial direction of the rotor cylindrical portion 12, or may be arranged with a magnetic body (not illustrated) interposed between them. For example, in the latter case, a magnetic body (cylindrical body or a plurality of magnetic pieces arranged in a circumferential direction) may be arranged on an inner surface in the radial direction of the rotor cylindrical portion 12, and the magnet 13 may be arranged on an inner surface in the radial direction of the magnetic body.

The first protruding portion 14 is a shaft (rotating shaft) of the rotor 1. The first protruding portion 14 protrudes in the one axial direction Da from the rotor lid portion 11 and extends along the central axis CA. As described above, the rotor 1 includes the first protruding portion 14. The first protruding portion 14 is rotatably supported by the bearing 32. Further, a hole portion 141 extending in the another axial direction Db is arranged in an end portion in one axial direction of the first protruding portion 14. The hole portion 141 is a recessed portion recessed in the another axial direction Db and extends along the central axis CA.

An axial length L1 of the hole portion 141 is less than half of an axial length L2 of the first protruding portion 14. With such a configuration, in the first protruding portion 14 rotatably supported by the bearing 32, the axial length L1 of a cylindrical portion having the hole portion 141 on the one axial direction Da side is smaller than the axial length L2 of a solid portion on the another axial direction Db side of the cylindrical portion. That is, more than half of the first protruding portion 14 is a solid columnar body. For this reason, strength, rigidity, and the like of the first protruding portion 14 can be improved. Further, the solid portion is connected to the rotor lid portion 11. For this reason, if a posture of the rotor 1 (and the impeller 102) is adjusted to adjust the rotational balance or the like after the fan motor 100 is assembled (in particular, after the first protruding portion 14 is supported by the bearing 32), distortion or the like caused by external force is less likely to occur in the first protruding portion 14 and the bearing 32. Therefore, strength, rigidity, and the like of a support structure of the first protruding portion 14 by the bearing 32 can be improved. Therefore, after the fan motor 100 and the motor 101 are assembled, a posture of the rotor 1 (and the impeller 102) can be safely adjusted.

The wall portion 15 protrudes in the one axial direction Da from the rotor lid portion 11 to surround an end portion in another axial direction of the bearing 32. As described above, the rotor 1 has the cylindrical wall portion 15. Furthermore, the wall portion 15 surrounds an end portion in another axial direction of the first protruding portion 14. That is, the wall portion 15 is a cylindrical body arranged on an end surface in one axial direction of the rotor lid portion 11 and extending in the axial direction. The wall portion 15 is arranged radially outward of the first protruding portion 14 and the bearing 32, and faces an end portion in another axial direction of the bearing 32 in the radial direction with a gap between them. The cylindrical wall portion 15 forms a cylindrical first space (reference numeral omitted) extending in the axial direction with an end portion in another axial direction of the bearing 32. The first space functions as a first labyrinth, and can prevent, for example, leakage of a fluid F to be described later between the first protruding portion 14 and the bearing 32, intrusion of water and dust from the outside to between the first protruding portion 14 and the bearing 32, and the like.

Note that the wall portion 15 may rotatably support an end portion in another axial direction of the bearing 32 without limitation to the example of the present example embodiment. That is, an inner surface in the radial direction of the wall portion 15 may be slidable in direct contact with an end portion in another axial direction of the bearing 32, or may be indirectly in contact with the end portion via the fluid F or the like. In this manner, the rotor 1 can rotate in a more balanced manner.

The second protruding portion 16 protrudes in the another axial direction Db from the rotor lid portion 11 and extends along the central axis CA. As described above, the rotor 1 includes the second protruding portion 16. That is, the second protruding portion 16 is a columnar body extending in the axial direction, and is arranged in a central portion of an end surface in another axial direction of the rotor lid portion 11.

Preferably, as illustrated in FIG. 1, an outer diameter φ2 of the second protruding portion 16 is larger than an outer diameter φ1 of the first protruding portion 14 when viewed from the axial direction. In this manner, thickness (for example, the sum of an axial width of the rotor lid portion 11 and an axial width W2 to be described later of the second protruding portion 16) of the rotor 1 in the vicinity of a connection portion between the first protruding portion 14 and the rotor lid portion 11 can be increased. Therefore, strength and rigidity of a connection portion between the two can be improved.

More preferably, as illustrated in FIG. 1, the outer diameter φ2 of the second protruding portion 16 is larger than an outer diameter φ3 of the bearing 32 when viewed from the axial direction. In this manner, thickness (for example, the sum of an axial width of the rotor lid portion 11 and the axial width W2 of the second protruding portion 16) of the rotor 1 in a wide range around a connection portion between the first protruding portion 14 and the rotor lid portion 11 when viewed from the axial direction can be increased. Therefore, strength and rigidity of the connection portion between the two can be further improved.

However, the above-described example does not exclude a configuration of φ1≥φ2 and a configuration of (φ1≤) φ2≤φ3, and does not exclude a configuration in which the second protruding portion 16 has a cylindrical shape extending in the axial direction.

Preferably, an end portion in another axial direction of the second protruding portion 16 of the motor 101 is arranged further in the another axial direction Db than an inner end portion in the radial direction of the impeller lid portion 1021. In other words, the axial width W2 of the second protruding portion 16 is larger than the axial width W1 of an inner end portion in the radial direction of the impeller lid portion 1021. In this manner, since the axial width W2 of the second protruding portion 16 can be further increased, thickness (for example, the sum of an axial width of the rotor lid portion 11 and an axial width W2 of the second protruding portion 16) of the rotor 1 in the vicinity of a connection portion between the first protruding portion 14 and the rotor lid portion 11 can be further increased. Therefore, strength and rigidity of the connection portion between the two can be further improved. However, this exemplification does not exclude a configuration of W1≥W2.

Note that, in the present example embodiment, the second protruding portion 16 has a gap from the impeller 102 (for example, an inner end portion in the radial direction of the impeller lid portion 1021, the impeller cap 1022). However, the present disclosure is not limited to this exemplification, and the second protruding portion 16 may be in contact with the impeller 102. For example, an outer end portion in the radial direction of the second protruding portion 16 may be in contact with the impeller 102. Further, the second protruding portion 16 (particularly, an end portion in another axial direction) may be in contact with the impeller 102 (particularly, the impeller cap 1022). With such a configuration, the second protruding portion 16 can be fitted into an opening of the impeller lid portion 1021, a recessed portion (reference numeral is omitted) on the one axial direction Da side of the impeller cap 1022, and the like. Therefore, the impeller 102 can be more firmly fixed to the rotor 1.

Further, in the present example embodiment, the rotor lid portion 11, the rotor cylindrical portion 12, the first protruding portion 14, the wall portion 15, and the second protruding portion 16 are integrated to constitute a single member. However, this exemplification does not exclude a configuration in which at least a part of them does not constitute a single member with another part. For example, the first protruding portion 14 does not need to be a single member while being integrated with at least the rotor lid portion 11 by insert molding or the like.

The stator 2 rotates the rotor 1 by a magnetic flux generated by energization. As illustrated in FIG. 1, the stator 2 includes the stator core 21, an insulator 22, and a coil portion 23.

The stator core 21 is an annular magnetic body surrounding the central axis CA, and in the present example embodiment, is a stacked in body which plate-shaped electromagnetic steel plates extending in the radial direction are stacked in the axial direction. The stator core 21 is fixed to an outer surface in the radial direction of a bearing holder 31. Further, the stator core 21 has a slot (not illustrated). A plurality of slots penetrate the stator core 21 in the axial direction and are aligned in the circumferential direction. In the stator core 21, a plurality of the coil portions 23 aligned in the circumferential direction are arranged.

The insulator 22 has electrical insulation, and is arranged on a surface of the stator core 21 (particularly, both end surfaces in the axial direction, an inner surface of a slot, and the like).

The coil portion 23 is a member in which a conductive wire (reference numeral is omitted) is arranged in a coil shape on the stator core 21 with the insulator 22 interposed between them. The conductive wire is, for example, an enamel-coated copper wire, a metal wire coated with an electrically insulating member, or the like, and is wound around a tooth (not illustrated) between slots adjacent to each other in the circumferential direction of the stator core 21 to form the coil portion 23. When drive current is supplied to each of the coil portions 23, the stator 2 is excited to drive the rotor 1.

The housing 3 includes the bearing holder 31, the bearing 32, and the base portion 33.

The bearing holder 31 has a cylindrical shape extending in the axial direction, and surrounds and holds the bearing 32. The motor 101 further includes the bearing holder 31. In addition, the bearing holder 31 surrounds the central axis CA and the first protruding portion 14, and holds the stator core 21 on its outer surface in the radial direction.

Further, the bearing holder 31 further surrounds at least the one axial direction Da side of the wall portion 15. With such a configuration, it is possible to further form a cylindrical second space (reference numeral is omitted) which extends in the axial direction between the wall portion 15 and the cylindrical bearing holder 31 (for example, a holder peripheral wall portion 312). The second space functions as a second labyrinth, and can further prevent, for example, leakage of the fluid F between the first protruding portion 14 and the bearing 32, intrusion of water and dust from the outside to between the first protruding portion 14 and the bearing 32, and the like.

For example, the bearing holder 31 includes a holder cylindrical portion 311 and the holder peripheral wall portion 312. The holder cylindrical portion 311 has a cylindrical shape extending in the axial direction and surrounds the central axis CA, the first protruding portion 14, and the bearing 32. The holder peripheral wall portion 312 has a cylindrical shape extending in the another axial direction Db from an end portion in another axial direction of the holder cylindrical portion 311, and surrounds at least the one axial direction Da side of the wall portion 15 of the rotor 1. That is, the holder peripheral wall portion 312 is arranged radially outward of the wall portion 15 and faces the wall portion 15 in the radial direction with a gap between them. Further, an end portion in another axial direction of the holder peripheral wall portion 312 faces, in the axial direction, an end surface in one axial direction of the rotor lid portion 11 with a gap between them.

Preferably, the holder peripheral wall portion 312 is arranged in an outer end portion in the radial direction in an end portion in another axial direction of the holder cylindrical portion 311. In this manner, an end portion in one axial direction of the wall portion 15 can face, in the axial direction, an end portion in another axial direction of the holder cylindrical portion 311 with a gap between them.

Therefore, an annular third space (reference numeral is omitted) can be further formed between the wall portion 15 and an end portion in another axial direction of the holder cylindrical portion 311. The third space can function as a third labyrinth. However, this exemplification does not exclude a configuration in which the holder peripheral wall portion 312 is arranged on the radially inward side (particularly, an inner end portion in the radial direction) in an end portion in another axial direction of the holder cylindrical portion 311.

Further, the bearing holder 31 further includes an inner flange portion 313. In the holder peripheral wall portion 312, the inner flange portion 313 expands radially inward from an end portion in one axial direction of the holder cylindrical portion 311 and extends in the circumferential direction. For example, the inner flange portion 313 may have an annular shape surrounding the central axis CA. However, this exemplification does not exclude a configuration in which the inner flange portion 313 does not have the annular shape as described above.

The bearing 32 is arranged on an inner peripheral surface (that is, an inner surface in the radial direction) of the bearing holder 31. The bearing 32 has a cylindrical shape extending in the axial direction and surrounds the first protruding portion 14. In other words, the first protruding portion 14 is inserted into the bearing holder 31 and the bearing 32. The bearing holder 31 rotatably supports the first protruding portion 14 via the bearing 32. Further, an end surface in one axial direction of the bearing 32 faces in axial direction an end surface in another axial direction of a flange portion 52 described later of the stop portion 5 with the fluid F interposed between them. An end surface in another axial direction of the bearing 32 faces in axial direction an end surface in one axial direction of the rotor lid portion 11 with the fluid F interposed between them. An inner surface in the radial direction of the bearing 32 faces in the radial direction an outer surface in the radial direction of the first protruding portion 14 with the fluid F interposed between them.

The bearing 32 is a sleeve that functions as a fluid dynamic pressure bearing in the present example embodiment. The fluid F is arranged between the first protruding portion 14 and the bearing 32. The fluid F is lubricating oil in the present example embodiment. However, the present disclosure is not limited to this exemplification, and the fluid F may be liquid other than lubricating oil or gas such as air. On at least one of an outer surface in the radial direction of the first protruding portion 14 and an inner surface in the radial direction of the bearing 32, a third dynamic pressure groove 63 to be described later for generating dynamic pressure in the fluid F interposed between them is arranged. When a shaft 10 rotates, the third dynamic pressure groove 63 generates dynamic pressure in the fluid F between them. This dynamic pressure separates the bearing 32 from the first protruding portion 14. By the above, the rotating first protruding portion 14 is rotatably supported in a non-contact state with the bearing 32.

Further, in the present example embodiment, the bearing 32 has a protruding wall portion 321. The protruding wall portion 321 protrudes in the one axial direction Da in an outer end portion in the radial direction of an end portion in one axial direction of the bearing 32. The protruding wall portion 321 has a cylindrical shape surrounding the central axis CA and the stop portion 5 (flange portion 52 described later). The protruding wall portion 321 faces the flange portion 52 in the radial direction and faces the inner flange portion 313 of the bearing holder 31 in the axial direction.

The base portion 33 is arranged further in the one axial direction Da than the stator 2 and expands radially outward from an end portion in one axial direction of the bearing holder 31. The base portion 33 includes a plate portion 331, an inner peripheral wall portion 332, and an outer peripheral wall portion 333. The plate portion 331 expands radially outward from an end portion in one axial direction of the bearing holder 31 (holder cylindrical portion 311) and extends in the circumferential direction. In the present example embodiment, the plate portion 331 has an annular shape surrounding an end portion in one axial direction of the bearing holder 31. The inner peripheral wall portion 332 is arranged in an end portion in one axial direction of the bearing holder 31, extends in the another axial direction Db from an inner end portion in the radial direction of the plate portion 331, and expands in the circumferential direction. The outer peripheral wall portion 333 extends in the another axial direction Db from an outer end portion in the radial direction of the plate portion 331 and expands in the circumferential direction. An inner end portion in the radial direction of the rib 104 is connected to an outer surface in the radial direction of the outer peripheral wall portion 333. In the present example embodiment, the inner peripheral wall portion 332 and the outer peripheral wall portion 333 have a cylindrical shape extending in the axial direction.

The circuit board 4 is arranged on an end surface in another axial direction of the plate portion 331 of the base portion 33. The circuit board 4 is electrically connected to a lead wire (reference numeral is omitted) drawn out from the coil portion 23. A drive circuit of the stator 2 and the like are mounted on the circuit board 4 and the circuit board 4 is electrically connected to an external wiring (not illustrated). The external wiring is drawn out to the outside of the motor 101, and electrically connects the circuit board 4 to an external device, a power supply, and the like.

The stop portion 5 is attached to an end portion in one axial direction of the first protruding portion 14. As described above, the motor 101 includes the stop portion 5. As described above, the stop portion 5 is attached to an end portion in one axial direction of the first protruding portion 14 and is rotatable about the central axis CA together with the rotor 1 (particularly, the first protruding portion 14).

The stop portion 5 has a column portion 51. The column portion 51 is a columnar body extending in the axial direction, and is fitted into the hole portion 141 of the first protruding portion 14. That is, the column portion 51 is accommodated in the hole portion 141. In the hole portion 141, a fourth space (reference numeral is omitted) is arranged further in the another axial direction Db than the column portion 51. That is, an end portion in another axial direction of the column portion 51 faces an inner surface (that is, an end surface in another axial direction) facing the one axial direction Da of the hole portion 141 in the axial direction with a gap (that is, the fourth space) between them. In this manner, the column portion 51 can be inserted into the hole portion 141 more reliably and stably. Therefore, the stop portion 5 can be more accurately attached to an end portion in one axial direction of the first protruding portion 14.

The stop portion 5 further includes the flange portion 52. The flange portion 52 is arranged further in the one axial direction Da than the first protruding portion 14 and expands in the radial direction. For example, the flange portion 52 has a disk shape and expands radially outward from end portion in one axial direction of the column portion 51.

Note that, as a means for attaching the stop portion 5 to the first protruding portion 14, adhesion using an adhesive, welding, brazing using silver wax or the like, screwing, press-fitting of the column portion 51, or the like can be employed.

A plurality of the dynamic pressure grooves 6 are a wedge-shaped pattern arranged in the circumferential direction, and constituted by a plurality of grooves. The dynamic pressure groove 6 is arranged on at least one of a pair of facing surfaces, and generates dynamic pressure in the fluid F interposed between the facing surfaces.

The first dynamic pressure groove 61 as the dynamic pressure groove 6 is arranged on either (at least a part of) an end surface in one axial direction of the bearing 32 or (at least a part of) an end surface in another axial direction of the flange portion 52. In the present example embodiment, the first dynamic pressure groove 61 is arranged on an end surface in one axial direction of the bearing 32. By the above, the first dynamic pressure groove 61 can generate dynamic pressure in a thrust direction (that is, the axial direction) between an end surface in one axial direction of the bearing 32 and an end surface in another axial direction of the flange portion 52 facing each other in the axial direction with the fluid F interposed between them. Due to the dynamic pressure, the bearing 32 can function as a fluid dynamic pressure bearing with respect to the flange portion 52 of the stop portion 5. Here, the first dynamic pressure groove 61 is connected to an end portion in one axial direction of the third dynamic pressure groove 63 on the one axial direction Da side in the present example embodiment, but does not need to be connected without limitation to this exemplification.

The second dynamic pressure groove 62 as the dynamic pressure groove 6 is arranged on either (at least a part of) an end surface in another axial direction of the bearing 32 or an end surface in another axial direction of the rotor lid portion 11. In the present example embodiment, the second dynamic pressure groove 62 is arranged on an end surface in another axial direction of the bearing 32. By the above, the second dynamic pressure groove 62 can generate dynamic pressure in a thrust direction between an end surface in another axial direction of the bearing 32 and an end surface in one axial direction of the rotor lid portion 11 facing each other in the axial direction with the fluid F interposed between them. Due to the dynamic pressure, the bearing 32 can function as a fluid dynamic pressure bearing with respect to the rotor lid portion 11. Here, the second dynamic pressure groove 62 is connected to an end portion in another axial direction of the third dynamic pressure groove 63 on the another axial direction Db side in the present example embodiment, but does not need to be connected without limitation to this exemplification.

For example, the first dynamic pressure groove 61 and the second dynamic pressure groove 62 of the dynamic pressure groove 6 include a first groove and a second groove. The first groove extends radially inward toward one circumferential direction. The second groove extends radially outward toward one circumferential direction. For example, the second groove extends from an end portion in one circumferential direction of the first groove. By the above, the first groove and the second groove form a wedge shape. The first dynamic pressure groove 61 and the second dynamic pressure groove 62 include a plurality of wedge-shaped grooves arranged in the circumferential direction. Note that a shape (in other words, pattern) formed by the first groove and the second groove is not limited to this exemplification, and various shapes can be formed as long as the first groove and the second groove are included. For example, at least one of the first dynamic pressure groove 61 and the second dynamic pressure groove 62 may have a herringbone shape or a zigzag shape.

Note that, in the present example embodiment, the motor 101 includes both the first dynamic pressure groove 61 and the second dynamic pressure groove 62. Note that the present disclosure is not limited to this exemplification, and either the first dynamic pressure groove 61 or the second dynamic pressure groove 62 may be omitted. That is, the motor 101 only needs to include the dynamic pressure groove 6 of at least one of the first dynamic pressure groove 61 and the second dynamic pressure groove 62. In this manner, it is possible to prevent shaking of the rotor 1 (particularly, the first protruding portion 14) in the axial direction by at least one of the first dynamic pressure groove 61 and the second dynamic pressure groove 62.

As the dynamic pressure groove 6, the third dynamic pressure groove 63 is arranged on either (at least a part of) an inner surface in the radial direction of the bearing 32 or (at least a part of) an outer surface in the radial direction of the first protruding portion 14. In the present example embodiment, the third dynamic pressure groove 63 is arranged on a part of an inner surface in the radial direction of the bearing 32. By the above, the third dynamic pressure groove 63 can generate dynamic pressure in the radial direction between an inner surface in the radial direction of the bearing 32 and an outer surface in the radial direction of the first protruding portion 14 that face each other in the radial direction with the fluid F interposed between them. Due to the dynamic pressure, the bearing 32 can function as a fluid dynamic pressure bearing with respect to the first protruding portion 14. Therefore, the third dynamic pressure groove 63 can prevent shaking of the rotor 1 (particularly, the first protruding portion 14) in the radial direction.

For example, the third dynamic pressure groove 63 of the dynamic pressure groove 6 includes a third groove and a fourth groove. The first groove extends in the one axial direction Da toward one circumferential direction. The fourth groove extends in the another axial direction Db toward one circumferential direction. For example, the fourth groove extends from an end portion in one circumferential direction of the third groove. By the above, the third groove and the fourth groove form a wedge shape. The third dynamic pressure groove 63 includes a plurality of wedge-shaped grooves arranged in the circumferential direction. Note that a shape (in other words, pattern) formed by the third groove and the fourth groove is not limited to this exemplification, and various shapes can be formed as long as the third groove and the fourth groove are included. For example, a shape of the third dynamic pressure groove 63 may be a herringbone shape or a zigzag shape.

In addition, in a configuration in which the wall portion 15 of the rotor 1 rotatably holds an end portion in another axial direction of the bearing 32, the motor 101 may include a fourth dynamic pressure groove (not illustrated) as the dynamic pressure groove 6. The fourth dynamic pressure groove is arranged on either an inner peripheral surface (that is, an inner surface in the radial direction) of the wall portion 15 or an outer surface in the radial direction in an end portion in another axial direction of the bearing 32. Further, the fourth dynamic pressure groove may or may not be connected to an outer end portion in the radial direction of the second dynamic pressure groove 62. Note that, similarly to the third dynamic pressure groove 63, the fourth dynamic pressure groove can include a plurality of wedge-shaped grooves arranged in the circumferential direction. Alternatively, the fourth dynamic pressure groove may have a herringbone shape or a zigzag shape.

With such a configuration, the fourth dynamic pressure groove can generate dynamic pressure in the radial direction between an outer surface in the radial direction of the bearing 32 and an inner peripheral surface of the wall portion 15 which face each other in the radial direction with the fluid F interposed between them. Due to the dynamic pressure, the bearing 32 can function as a fluid dynamic pressure bearing with respect to the wall portion 15. However, this exemplification does not exclude a configuration in which the motor 101 does not include the fourth dynamic pressure groove in a configuration in which the wall portion 15 rotatably holds an end portion in another axial direction of the bearing 32.

The example embodiments of the present disclosure are described above. It is to be noted that the scope of the present disclosure is not limited to the above-described example embodiment. The present disclosure is implemented by adding various modifications to the above-described example embodiments within a range not departing from the spirit of the disclosure. Further, the matters described in the above-described example embodiments can be optionally combined together as appropriate within a range where no inconsistency occurs.

For example, in the present example embodiment, the bearing 32 functions as a fluid dynamic pressure bearing. However, this exemplification does not exclude a configuration in which the bearing 32 does not function as a fluid dynamic pressure bearing. For example, an exemplification of the present example embodiment does not exclude a configuration in which the bearing 32 is a plain bearing and the dynamic pressure groove 6 (and the fluid F) is omitted.

Hereinafter, the example embodiments described above will be collectively described below.

For example, the motor disclosed in the present description is a motor having a configuration (first configuration) including a bearing and a rotor supported by the bearing to be rotatable about a central axis extending in an axial direction, the rotor includes a rotor lid portion extending in a radial direction and a first protruding portion protruding in one axial direction from the rotor lid portion, extending along the central axis, and rotatably supported by the bearing. The bearing has a cylindrical shape extending in the axial direction and surrounds the first protruding portion, a hole extending in another axial direction is located in an end portion in the one axial direction of the first protruding portion, and an axial length of the hole is less than about half of an axial length of the first protruding portion.

Note that the motor having the first configuration may have a configuration (second configuration) that further includes a stop portion attached to an end portion in one axial direction of the first protruding portion, and at least one dynamic pressure groove of a first dynamic pressure groove and a second dynamic pressure groove, wherein the stop portion includes a flange portion that extends farther in the one axial direction than the first protruding portion and expands in a radial direction, the dynamic pressure groove includes a first groove extending radially inward toward one circumferential direction, and a second groove extending radially outward toward the one circumferential direction. An end surface in the one axial direction of the bearing opposes an end surface in the one axial direction of the flange portion in the axial direction with fluid interposed therebetween; the first dynamic pressure groove is located on either an end surface in the one axial direction of the bearing or an end surface in the another axial direction of the flange portion; an end surface in the another axial direction of the bearing opposes an end surface in the one axial direction of the rotor lid portion in the axial direction with the fluid interposed therebetween; and the second dynamic pressure groove is located on either an end surface in the another axial direction of the bearing or an end surface in the one axial direction of the rotor lid portion.

Further, the motor the having first or second configuration may have a configuration (third configuration) in which the rotor further includes a cylindrical wall portion that protrudes in the one axial direction from the rotor lid portion and surrounds an end portion in the another axial direction of the bearing.

Further, the motor having the third configuration may have a configuration (fourth configuration) that further includes a cylindrical bearing holder that extends in the axial direction and surrounds and holds the bearing, in which the bearing holder further surrounds at least a one axial direction side of the wall portion.

The motor according to any of the first to fourth configurations may have a configuration (fifth configuration) in which the rotor further includes a second protruding portion that protrudes in the another axial direction from the rotor lid portion and extends along the central axis; and an outer diameter of the second protruding portion is larger than an outer diameter of the first protruding portion when viewed from the axial direction.

Further, the motor having the fifth configuration may have a configuration (sixth configuration) in which an outer diameter of the second protruding portion is larger than an outer diameter of the bearing when viewed from the axial direction.

A fan motor disclosed in the present description has a configuration (seventh configuration) that includes a motor having any of the first to sixth configurations.

Further, the fan motor having the seventh configuration may have a configuration (eighth configuration) that further includes an impeller rotatable about the central axis together with the rotor of the motor, in which the rotor further includes a rotor cylindrical portion extending in the one axial direction from an outer end portion in a radial direction of the rotor lid portion, and the impeller is fixed to the rotor lid portion and the rotor cylindrical portion.

Alternatively, a fan motor disclosed in the present description has a configuration (ninth configuration) that includes the motor having the fifth or sixth configuration, and an impeller that is rotatable about the central axis together with the rotor of the motor and is fixed to at least the rotor lid portion of the rotor, wherein the impeller includes an impeller lid portion having an annular shape surrounding the second protruding portion and located on an end surface in another axial direction of the rotor lid portion, and an end portion in the another axial direction of the second protruding portion of the motor is farther in the another axial direction than an inner end portion in a radial direction of the impeller lid portion.

Further, the fan motor having the eighth or ninth configuration may have a configuration (tenth configuration), in which in the axial direction, an upper surface of the rotor lid portion opposes the impeller with an annular gap surrounding the central axis therebetween.

Further, the fan motor having any of the eighth to tenth configurations may have a configuration (eleventh configuration) in which a material of the impeller is polycarbonate resin.

Example embodiments of the present disclosure are useful for motors in which a shaft is rotatably supported by a cylindrical bearing, and devices including the motors.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A motor comprising:

a bearing; and a rotor supported by the bearing to be rotatable about a central axis extending in an axial direction; wherein the rotor includes:

a rotor lid portion extending in a radial direction; and a first protruding portion protruding in one axial direction from the rotor lid portion, extending along the central axis, and rotatably supported by the bearing;

the bearing has a cylindrical shape extending in the axial direction and surrounds the first protruding portion;

a blind hole extending in another axial direction is located in an end portion in the one axial direction of the first protruding portion;

an axial length of the blind hole from an opening of the blind hole to a closed end of the blind hole is less than about half of an axial length of the first protruding portion;

the rotor further includes a second protruding portion that protrudes in the another axial direction from the rotor lid portion and extends along the central axis;

an outer diameter of the second protruding portion is larger than an outer diameter of the first protruding portion when viewed from the axial direction;

the motor further includes an impeller that is rotatable about the central axis together with the rotor and is fixed to at least the rotor lid portion of the rotor;

the impeller includes an impeller lid portion having an annular shape surrounding the second protruding portion and located on an end surface in another axial direction of the rotor lid portion; and an end portion in the another axial direction of the second protruding portion of the motor extends farther in the another axial direction than an inner end portion in a radial direction of the impeller lid portion.

2. The motor according to claim 1, further comprising:

a stop portion attached to an end portion in one axial direction of the first protruding portion; and at least one dynamic pressure groove of a first dynamic pressure groove and a second dynamic pressure groove; wherein the stop portion includes a flange portion that extends farther in the one axial direction than the first protruding portion and expands in a radial direction;

the dynamic pressure groove includes:

a first groove extending radially inward toward one circumferential direction; and a second groove extending radially outward toward the one circumferential direction;

an end surface in the one axial direction of the bearing opposes an end surface in the one axial direction of the flange portion in the axial direction with fluid interposed therebetween;

the first dynamic pressure groove is located on either an end surface in the one axial direction of the bearing or an end surface in the another axial direction of the flange portion;

an end surface in the another axial direction of the bearing opposes an end surface in the one axial direction of the rotor lid portion in the axial direction with the fluid interposed therebetween; and the second dynamic pressure groove is located on either an end surface in the another axial direction of the bearing or an end surface in the one axial direction of the rotor lid portion.

3. The motor according to claim 1, wherein the rotor further includes a cylindrical wall portion that protrudes in the one axial direction from the rotor lid portion and surrounds an end portion in the another axial direction of the bearing.

4. The motor according to claim 3, further comprising a cylindrical bearing holder that extends in the axial direction and surrounds and holds the bearing; wherein the bearing holder further surrounds at least a one axial direction side of the wall portion.

5. The motor according to claim 1, wherein an outer diameter of the second protruding portion is larger than an outer diameter of the bearing when viewed from the axial direction.

6. A fan motor comprising the motor according to claim 1.

7. The motor according to claim 1, further comprising an impeller rotatable about the central axis together with the rotor of the motor; wherein the rotor further includes a rotor cylindrical portion extending in the one axial direction from an outer end portion in a radial direction of the rotor lid portion; and the impeller is fixed to the rotor lid portion and the rotor cylindrical portion.

8. The motor according to claim 7, wherein in the axial direction, an upper surface of the rotor lid portion opposes the impeller with an annular gap surrounding the central axis therebetween.

9. The motor according to claim 7, wherein a material of the impeller is polycarbonate resin.

* * * * *